US005594804A

United States Patent [19]

Kim

[11] Patent Number: 5,594,804

[45] Date of Patent: Jan. 14, 1997

[54] MULTIPLE CONE TYPE LOUDSPEAKER

[76] Inventor: Kyung W. Kim, 3-391 Ju Kong Apt. Hupyung 2 Dong, Choonchun City, Kangwon Do, Rep. of Korea

[21] Appl. No.: 433,554

[22] Filed: May 1, 1995

[30] Foreign Application Priority Data

Apr. 29, 1994 [KR] Rep. of Korea ..... 94-9745

[51] Int. Cl.[6] ..... H04R 25/00

[52] U.S. Cl. ..... 381/186; 381/204; 381/182; 181/144; 181/147

[58] Field of Search ..... 381/204, 182, 381/186, 185, 188, 205; 181/144, 147, 163, 164, 165, 171, 199

[56] References Cited

U.S. PATENT DOCUMENTS 1,897,294 2/1933 Bernard ..... 381/204

1,932,459 10/1933 Harris ..... 381/204

3,061,675 10/1962 MacDonald ..... 181/144

*Primary Examiner*—Sinh Tran

*Attorney, Agent, or Firm*—Hoffmann & Baron

[57] ABSTRACT

A multiple cone type loudspeaker having a construction including a plurality of vibrating plates and a plurality of baffle plates protruded forwards from an enclosure of the loudspeaker. Each of the baffle plates serves to effectively isolate both spaces respectively defined at front and back sides of each corresponding one of the vibrating plates protruded forwards beyond the front surface of the enclosure. As a result, there is no phenomenon that the density of air is equalized in both spaces respectively defined at front and back sides of each vibrating plate as the vibration of the vibrating plate is continued. Accordingly, it is possible to achieve an extension in regeneration band, an improvement in directivity and a generation of dynamic sound.

1 Claim, 1 Drawing Sheet

MULTIPLE CONE TYPE LOUDSPEAKER

BACKGROUND OF THE INVENTION

1. Field of the Invention

The present invention relates to a loudspeaker, and more particularly to a multiple cone type loudspeaker including a plurality of vibrating plates.

2. Description of the Prior Art

Generally, loudspeakers are based on the principle that when a conduction wire in which current flows is under the influence of a certain magnetic field, it is subjected to a physical force to move it. In a loudspeaker of the general type, a voice coil is provided, which serves as the conduction wire in accordance with the above-mentioned principle. To the voice coil, a vibrating plate is attached. When voice current from an amplifier flows in the voice coil, the voice coil moves, thereby causing the vibrating plate to vibrate. As a result, a sound is generated.

Referring to FIG. 1, there is illustrated a double cone type loudspeaker. In the double cone type loudspeaker, a vibrating plate and a sub-cone are moved together by a single voice coil. FIG. 2 is a schematic view for explaining the principle of the double cone type loudspeaker. When the sub-cone denoted by the reference numeral 1' in FIG. 2 moves forwards, a space in the front side of the sub-cone 1' is reduced, thereby increasing the density of air particles 3 existing therein, while a space in the back side of the sub-cone 1' is increased due to the movement of the sub-cone 1', thereby decreasing the density of air therein. By referring to FIG. 2, such a phenomenon can be clearly found. When the sub-cone 1' moves reversely, a phenomenon contrary to that mentioned above occurs.

The variation in the density of air particles 3 generated by the movement of the sub-cone 1' are spread in all directions. As a result, the density of air is almost equalized in both spaces respectively defined at front and back sides of the sub-cone 1' as the vibration of the sub-cone 1' is continued. At a place far apart from the sub-cone 1', a variation in density having little relation the movement of the sub-cone 1' is exhibited. Consequently, the double cone type loudspeaker involves a problem that it exhibits its effect only for a sound of a certain level.

SUMMARY OF THE INVENTION

Therefore, an object of the invention is to eliminate the above-mentioned problem encountered in the prior art and to provide a loudspeaker having a multiple cone construction capable of achieving an extension in regeneration band, an improvement in directivity and a generation of dynamic sound.

In accordance with the present invention, this object is to be accomplished by providing a loudspeaker comprising a housing, a bobbin attached with a voice coil and a frame fixedly mounted to the housing, a vibrating plate mounted at an inner peripheral edge thereof to the bobbin and at an outer peripheral edge thereof to the frame, the loudspeaker further comprising: an additional bobbin attached to a front end of the bobbin such that it is coaxial with the bobbin and protruded forwards beyond a front surface of the housing; a plurality of uniformly spaced additional vibrating plates arranged along the additional bobbin such that they are symmetrical with respect to an axis of the additional bobbin, each of the additional vibrating plates being bonded at an inner peripheral edge thereof to an outer surface of the additional bobbin and protruded forwards beyond the front surface of the housing; and a plurality of radially extending baffle plates mounted to the frame such that they surround the additional vibrating plates, respectively, each of the baffle plates having an inner peripheral edge to which each corresponding one of the additional vibrating plates is bonded.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENT

Figure 3:
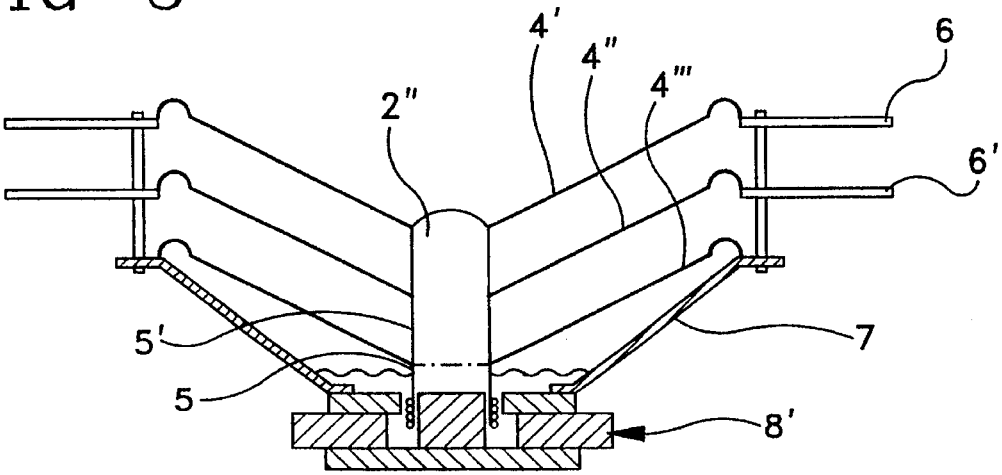
FIG. 3 is a sectional view illustrating a multiple cone type loudspeaker in accordance with the present invention.

Referring to FIG. 3, there is illustrated a loudspeaker having a multiple cone construction in accordance with the present invention.

As shown in FIG. 3, the loudspeaker which is denoted by the reference numeral 8' includes a bobbin 5 having the same construction as those of conventional loudspeakers. In accordance with the present invention, an additional bobbin 5' is attached to a front end of the bobbin 5 such that it is coaxial with the bobbin 5 and protruded forwards beyond the front surface of a housing (not shown) of the loudspeaker 8'. A plurality of uniformly spaced vibrating plates (in the illustrated case, three vibrating plates 4', 4" and 4'") are arranged along the additional bobbin 5' such that they are symmetrical with respect to the axis of the additional bobbin 5'. Each of the vibrating plates 4', 4" and 4'" is bonded at its inner peripheral edge to the outer surface of the additional bobbin 5'. The rearmost vibrating plate 4'" is arranged such that its outer peripheral edge is substantially flush with the front surface of the housing, as in conventional loudspeakers. The remaining vibrating plates 4" and 4'" are protruded forwards beyond the front surface of the housing.

The loudspeaker also includes a plurality of baffle plates (in the illustrated case, two baffle plates 6 and 6') mounted to a frustum-shaped frame 7 fixed to a fixed member of the loudspeaker by means of elongated bolts such that they extend radially and surround those of the baffle plates protruded forwards of the housing of the loudspeaker, respectively. In the illustrated case, the vibrating plates 4' and 4" protruded forwards of the housing of the loudspeaker are bonded at their outer peripheral edges to the inner peripheral edges of the baffle plates 6 and 6', respectively. On the other hand, the vibrating plate 4'" flush with the front surface of the housing is bonded at its outer peripheral edge to the outer peripheral edge of the frame 7.

Each of the baffle plates 6 and 6' serves to effectively isolate both spaces respectively defined at front and back sides of each corresponding one of the vibrating plates 4" and 4'" protruded forwards beyond the front surface of the housing. As a result, there is no phenomenon that the density of air is equalized in both spaces respectively defined at front and back sides of each vibrating plate as the vibration of the vibrating plate is continued. Accordingly, it is possible to achieve an extension in regeneration band, an improvement in directivity and a generation of dynamic sound.

Figure 1:
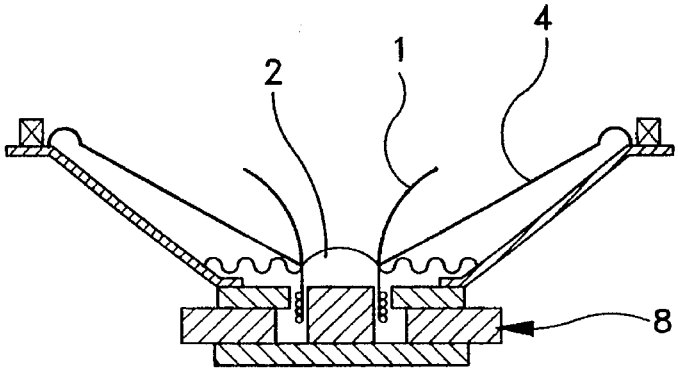
FIG-1 PRIOR ART
FIG. 1 is a sectional view illustrating a conventional double cone type loudspeaker.
Figure 2:
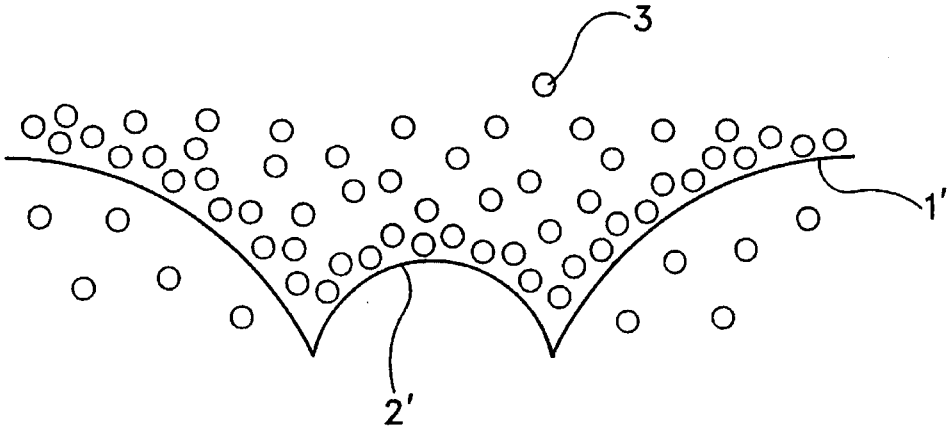
FIG-2 PRIOR ART
FIG. 2 is a schematic view for explaining variations in air density respectively generated in both spaces defined at front and back sides of a sub-cone in the loudspeaker of FIG. 1.

The multiple cone construction according to the present invention can be easily applied to existing loudspeakers because its essential parts are arranged outward of the enclosure of the loudspeaker. Where the multiple cone construction of the present invention is to be assembled in a conventional loudspeaker including a center cap and a sub-cone as the case of FIG. 1, the assembling can be achieved by separating the center cap and sub-cone from the loudspeaker to expose a bobbin of the loudspeaker, attaching the additional bobbin 5' of the present invention to the exposed end of the bobbin, and then attaching the vibrating plates and baffle plates.

As apparent from the above description, the present invention provides a multiple cone type loudspeaker having a construction including a plurality of vibrating plates and a plurality of baffle plates protruded forwards from an enclosure of the loudspeaker, thereby capable of an extension in regeneration band, an improvement in directivity and a generation of dynamic sound.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A loudspeaker comprising a housing, a bobbin attached with a voice coil and a frame fixedly mounted to the housing, a vibrating plate mounted at an inner peripheral edge thereof to the bobbin and at an outer peripheral edge thereof to the frame, the loudspeaker further comprising:

an additional bobbin attached to a front end of the bobbin such that it is coaxial with the bobbin and protruded forwards beyond a front surface of the housing;

a plurality of uniformly spaced additional vibrating plates arranged along the additional bobbin such that they are symmetrical with respect to an axis of the additional bobbin, each of the additional vibrating plates being bonded at an inner peripheral edge thereof to an outer surface of the additional bobbin and protruded forwards beyond the front surface of the housing; and a plurality of radially extending baffle plates mounted to the frame such that they surround the additional vibrating plates, respectively, each of the baffle plates having an inner peripheral edge to which each corresponding one of the additional vibrating plates is bonded.

* * * * *